US010231586B2

(12) United States Patent
Boughtwood

(10) Patent No.: US 10,231,586 B2
(45) Date of Patent: Mar. 19, 2019

(54) VACUUM CLEANER

(71) Applicant: Martin Hugh Boughtwood, Caerphilly (GB)

(72) Inventor: Martin Hugh Boughtwood, Caerphilly (GB)

(73) Assignee: DEREGALLERA HOLDINGS LTD, Cardiff (GB)

( * ) Notice: Subject to any disclaimer, the term of this patent is extended or adjusted under 35 U.S.C. 154(b) by 418 days.

(21) Appl. No.: 14/899,517

(22) PCT Filed: Jun. 24, 2014

(86) PCT No.: PCT/GB2014/051927
§ 371 (c)(1),
(2) Date: Dec. 17, 2015

(87) PCT Pub. No.: WO2014/207449
PCT Pub. Date: Dec. 31, 2014

(65) Prior Publication Data

US 2016/0150930 A1 Jun. 2, 2016

(30) Foreign Application Priority Data

Jun. 27, 2013 (GB) ..... 1311451.7

(51) Int. Cl.
*A47L 5/22* (2006.01)
*A47L 9/12* (2006.01)
(Continued)

(52) U.S. Cl.
CPC ..... *A47L 9/12* (2013.01); *A47L 5/22* (2013.01); *A47L 9/16* (2013.01); *A47L 9/1666* (2013.01);
(Continued)

(58) Field of Classification Search
CPC ..... A47L 5/22; A47L 9/12; A47L 9/16; A47L 9/18; A47L 9/1666; A47L 9/2842; A47L 9/2868; A47L 9/28
See application file for complete search history.

(56) References Cited

U.S. PATENT DOCUMENTS 6,198,195 B1 3/2001 Embree et al.
6,647,587 B1 * 11/2003 Ohara ..... A47L 5/22 15/346
(Continued)

FOREIGN PATENT DOCUMENTS

DE 102009038230 A1 2/2011
EP 0815788 A2 1/1998
(Continued)

OTHER PUBLICATIONS

PCT International Search Report for corresponding PCT International Patent Application No. PCT/GB2014/051927, dated Feb. 3, 2015.

*Primary Examiner* — David Redding
(74) *Attorney, Agent, or Firm* — Holland & Hart

(57) ABSTRACT

A vacuum cleaner comprising: a body defining an air inlet, an air outlet, and a passageway extending therebetween; an electrostatic dust filter for removing dust from air as it passes through the passageway; and an air pump for drawing air into the air inlet and through the passageway to the air outlet; wherein the electrostatic dust filter comprises an electrode arrangement configured to kill microorganisms present in air passing through the passageway by exposing air to a voltage in excess of a threshold voltage.

5 Claims, 2 Drawing Sheets

(51) Int. Cl.
*A47L 9/16* (2006.01)
*A47L 9/28* (2006.01)

(52) U.S. Cl.
CPC ..... *A47L 9/28* (2013.01); *A47L 9/2842* (2013.01); *A47L 9/2868* (2013.01)

(56) References Cited

U.S. PATENT DOCUMENTS

| | | | |
|---|---|---|---|
| 2002/0134238 | A1 | 9/2002 | Conrad et al. |
| 2004/0035093 | A1 | 2/2004 | Conrad et al. |
| 2012/0036675 | A1 | 2/2012 | Conrad |

FOREIGN PATENT DOCUMENTS

| | | | |
|---|---|---|---|
| GB | 1501927 | | 2/1978 |
| GB | 2418163 | A | 3/2006 |
| GB | 2472095 | A | 1/2011 |
| JP | H09182705 | A | 7/1997 |
| JP | 2007244526 | A | 9/2007 |
| WO | 2011010136 | A1 | 1/2011 |

* cited by examiner

VACUUM CLEANER

BACKGROUND

The present invention relates to vacuum cleaners and particularly, but not exclusively, vacuum cleaners for domestic use.

Typically vacuum cleaners in the art operate by creating a pressure difference by means of a rotating fan or impeller powered by an electric motor. The positive pressure is vented to atmosphere through a dispersion system, whilst the negative pressure is directed toward the end of a wand or tube that interfaces with the ground/object to be cleaned. The resulting flow of air through the vacuum cleaner passes through a dust trapping chamber either in the form of a porous bag having a porosity small enough to retain particles, or via a cyclonic chamber that catches the particles by virtue of centrifugal action acting on the swirling particles. The airflow continues from the top of the cyclonic chamber, or via an enclosing chamber in the case of a porous bag, to an exit filter before arriving at atmosphere in the form of a diffuse exhaust.

Various attempts over the years have been made to improve performance, for example by improving the efficiency of the impeller fan, by increasing the speed of the impeller fan, by carefully engineering the impeller to be a type of spiral form multi-blade turbine, by the use of cyclone technology where the air is directed to swirl so as to create a centrifugal component to the flow and to allow velocity increase by progressive reduction of swirl flow diameter.

Dust extraction in the present machines is principally a function of vacuum or negative pressure performance. This performance is in turn mostly dependent upon impeller design and efficiency. It is typically the case that impeller efficiency will be below 50%. However some recent turbine type impellers are purported to be as high as 70% efficiency. Total system performance is further reduced by factors such as loss through the wand system, and brush head design with respect to how air flow is constrained from atmosphere to the vacuum entry zone of the head.

With bag-type filters a small porosity will trap most particles, but too small a porosity results in flow constraints and large pressure drop across the bag. Thus there is a compromise that requires small particles to be let through the filter system. Cyclonic systems capture the primary dust particles by swirling centrifugal force acting on the particles causing them to be thrown against the container wall. Air flow from the container is filtered through a secondary system which again must have porosity to allow air through and so has to have a pathway for particles. Thus neither filtration technique is ideal or close to perfect and in both bag and cyclone systems the exhaust air flow by definition contains particles of dust and/or microbes that are too small for the filter systems to capture.

Problems are also associated with the ease of emptying dust collectors. Bags must be removed, unsealed and tipped into a waste bin. Often the bag is non-reusable and the whole bag is disposed of when full. In cyclonic system emptying typically has a removable vessel that is simply tipped up to dispose of the contents—at least this is the theory. In practice the vessel is often constructed of or coated with plastic material that becomes statically charged due to the movement and consequent friction of the particles of dust with the vessel inner surfaces. This triboelectric effect causes the particles to stick to the surfaces of the vessel and thus become difficult to empty.

Finally, the process of moving air at high velocities over insulate surfaces results in charge build up and substantial positive ionisation of the exhaust air. In particular this is an issue with high velocity cyclone type systems where the triboelectric effect is amplified by particle velocity and friction. The electric motor causes magnetically induced positive ionization whilst universal motors are more of an issue with brush sparking adding to the ionization effect and producing a fire hazard. The positive ionization is a known health hazard at worst and at best is believed to contribute to fuzziness of thought and higher propensity to illness.

SUMMARY

The present applicant has identified the need for an improved vacuum cleaner that overcomes or at least alleviates problems associated with the prior art.

In accordance with a first aspect of the present invention, there is provided a vacuum cleaner comprising: a body defining an air inlet, an air outlet, and a passageway extending therebetween; an electrostatic dust filter for removing dust (e.g. for collection in a dust collection chamber) from air as it passes through the passageway; and an air pump for drawing air into the air inlet and through the passageway to the air outlet; wherein the electrostatic dust filter comprises an electrode arrangement configured to kill microorganisms present in air passing through the passageway by exposing air to a voltage in excess of a threshold voltage.

In this way, a vacuum cleaner is provided in which efficient filtration is achieved together with removal of living microbes from the exhaust airflow.

The vacuum cleaner may be a domestic vacuum cleaner (e.g. mobile device mounted on wheels or hand-held device).

In one embodiment, the threshold voltage is at least 1000 V.

In one embodiment, the threshold voltage is at least 10,000 V.

In one embodiment, the threshold voltage is configured to substantially sterilise air passing through the passageway.

In one embodiment, the passageway or a component located in the passageway includes an airflow contact surface comprising a triboelectric coating provided on an electrically conductive underlayer configured to supply (e.g. direct or at a subsequent time via an energy storage device) a voltage to the electrode arrangement. In this way, static charges generated by the friction of air and dust particle motion over the airflow contact surface may be exploited thereby enhancing or assisting with at least one of the filtration, sterilisation and ionisation processes performed by the electrode arrangement.

In one embodiment, the air pump comprises an active element (e.g. blade of a fan or plate of a Tesla turbine as discussed below) including an airflow contact surface comprising a triboelectric coating provided on an electrically conductive underlayer configured to supply a voltage to the electrode arrangement.

In one embodiment, the electrostatic dust filter includes a cyclonic filter stage including a cyclonic airflow contact surface comprising a triboelectric coating provided on an electrically conductive underlayer configured to supply a voltage to the electrode arrangement.

In one embodiment, the vacuum cleaner is configured to generate an ionised airflow through the air outlet (e.g. negatively ionised airflow). In this way, airflow exiting the vacuum cleaner may be provided in a state more beneficial to health.

In one embodiment, the electrode arrangement provides a motive force to drive an electrostatic motor mechanically coupled to the air pump.

In one embodiment, the electrode arrangement is configured to provide a motive force to directly drive the air pump.

In one embodiment, the air pump comprises a Tesla turbine (e.g. boundary layer turbine) comprising at least one stator disc in combination with at least one rotor disc and the electrode arrangement is provided on the at least one stator disc to cause rotation of the corresponding rotor disc.

In one embodiment, the air pump comprises an electrostatic air pump (e.g. electrostatic fluid accelerator with no moving parts).

In accordance with a second aspect of the present invention, there is provided a vacuum cleaner comprising: a body defining an air inlet, an air outlet, and a passageway extending therebetween; a dust filter for removing dust (e.g. for collection in a dust collection chamber) from air as it passes through the passageway; and an air pump for drawing air into the air inlet and through the passageway to the air outlet; wherein the vacuum cleaner further comprises an electrode arrangement operative to provide a motive force to drive an electrostatic motor mechanically coupled to the air pump or to provide a motive force to directly drive the air pump.

In one embodiment, the air pump comprises a Tesla turbine comprising at least one stator disc in combination with at least one rotor disc and the electrode arrangement is provided on the at least one stator disc to cause rotation of the corresponding rotor disc.

In one embodiment, the passageway or a component located in the passageway includes an airflow contact surface comprising a triboelectric coating provided on an electrically conductive underlayer configured to supply a voltage to the electrode arrangement.

In one embodiment, the air pump comprises an active element (e.g. blade of a fan or plate of a Tesla turbine) including an airflow contact surface comprising a triboelectric coating provided on an electrically conductive layer configured to supply a voltage to the electrode arrangement.

In one embodiment, the electrostatic dust filter includes a cyclonic filter stage including a cyclonic airflow contact surface comprising a triboelectric coating provided on an electrically conductive underlayer configured to supply a voltage to the electrode arrangement.

In one embodiment, the vacuum cleaner is configured to generate an ionised airflow through the air outlet (e.g. negatively ionised airflow).

BRIEF DESCRIPTION OF THE DRAWINGS

Embodiments of the present invention will now be described by way of example with reference to the accompanying drawings in which.

DETAILED DESCRIPTION

Figure 1:
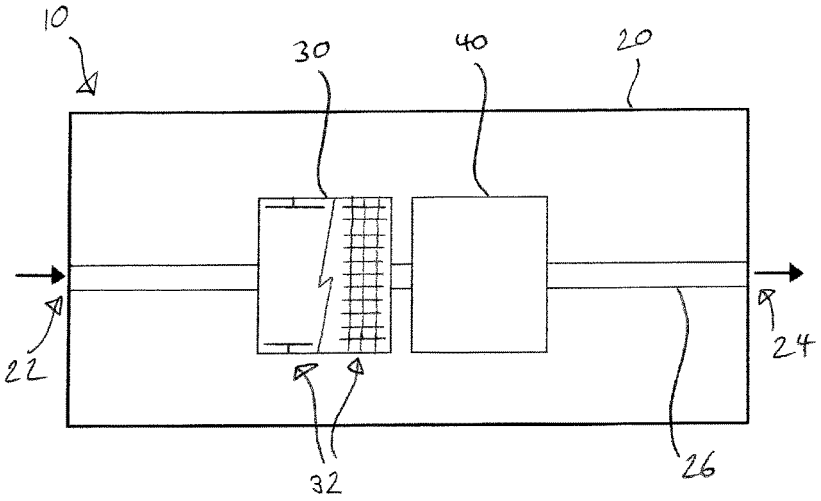
FIG. 1 is a schematic illustration of a vacuum cleaner in accordance with an embodiment of the present invention.

FIG. 1 shows a vacuum cleaner 10 comprising: a body 20 defining an air inlet 22, an air outlet 24, and a passageway 26 extending therebetween; an electrostatic dust filter 30 for removing dust from air as it passes through passageway 26; and an air pump 40 for drawing air into air inlet 22 and through passageway 26 to air outlet 24. Although the air inlet 22 and air outlet 24 are shown on opposed sides of body 20 in the schematic illustration, air inlet 22 and air outlet 24 may be arranged to be adjacent one another or preferably in a concentric relationship at the dust entry location (e.g. with air outlet 24 surrounding a wand brush head of the vacuum cleaner).

In accordance with the present invention, electrostatic dust filter 30 has two main functions: 1) to control the electrostatic charge on dust particles passing through passageway 26 so that the dust particles can be electrostatically filtered out; and 2) sterilisation of the air passing through passageway 26. Optionally, vacuum cleaner 10 (either by means of electrostatic dust filter 30 itself by means of a further charge control device located downstream of electrostatic dust filter 30) may be further configured to control the electrostatic charge on air exiting the passageway 26 via the air outlet 24 (e.g. to allow the vacuum cleaner to exhaust or otherwise emit air of a beneficial and typically negative state of ionization).

Electrostatic dust filter 30 comprises an electrode arrangement 32 configured to kill microorganisms (e.g. bacteria and bugs) present in air passing through the vacuum cleaner by exposing air to a voltage in excess of a threshold voltage of at least 1000 V and configured to substantially sterilise air passing through the passageway. In one embodiment, the threshold voltage is at least 10,000 V.

The facility to control the ionization state of the air/dust particles and sterilise the air can be implemented in a number of ways.

In a first embodiment, electrostatic dust filter 30 may comprise an ionising chamber configured to operate with an active input of power and constructed to provide minimum impedance to airflow whilst the chamber is fitted with an electrode arrangement 32 (e.g. two or more plate electrodes) powered so as to maintain an electrical field of adequate length in the airflow direction to ensure capture of a suitable proportion of dust particles (e.g. substantially all particles in the case that the ionising chamber is the only or primary dust filter of the vacuum cleaner). This applies to dust extraction of incoming air and also to beneficial ionization of outgoing air.

In another embodiment, electrostatic dust filter may comprise an electrode arrangement 32 in the form of an electrostatic filter screen comprising an electrically conductive body connected to a pulsed capacitor energy store. The surface of the filter screen may be coated with a triboelectric material that is at the negative end of the triboelectric series and thus develops a negative charge as the airflow passes over the surface. The coating is selected to be sufficiently thin (e.g. 5 nm or less in thickness) so as to allow quantum tunneling of current through to the electrically conductive body. This results in the airflow being charged positive as it leaves the filter and an accumulation of electrons in the energy store.

Air pump 40 may comprise any means for generating a vacuum including but not limited to a vacuum impeller, a Tesla turbine and an electrostatic fluid accelerator (EFA). In one embodiment, electrode arrangement 32 may provides a motive force to drive an electrostatic motor mechanically coupled to the air pump or may even be configured to provide a motive force to directly drive the air pump (see discussion of Tesla turbine embodiment below).

In the case of a mechanical air pump, an active part (e.g. moving blades) of air pump 40 may include an electrically conductive underlayer with a thin (e.g. 5 nm or less in thickness) triboelectric layer, this time at the positive end of the scale and thus configured to develop a positive charge by delivering electrons to the positive charge of the moving air/particles. The positive charge is stored on the opposite side of the energy store and provides a balance to the negative store side. This stored charge may be used as part of the cleaning/purifying ionization/filtering process.

Figure 2:
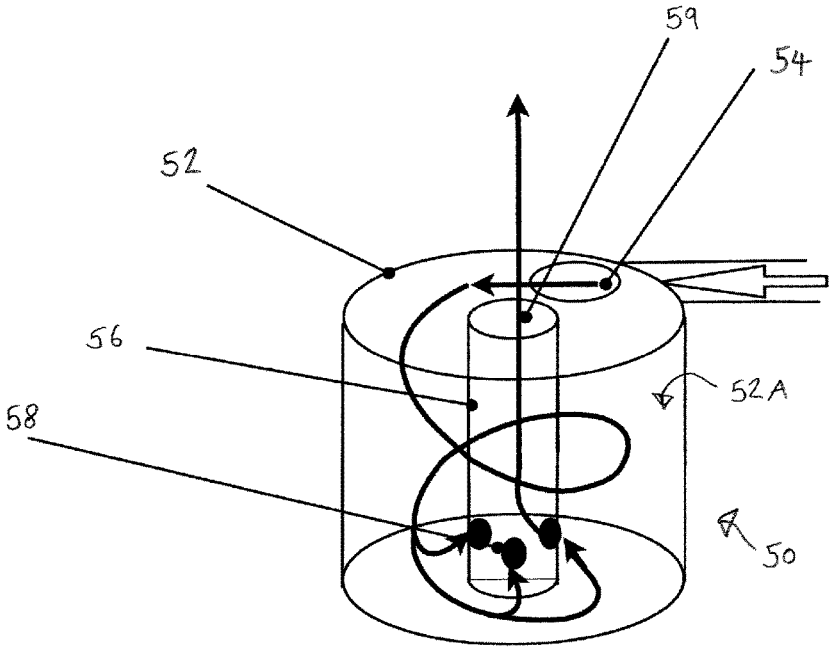
FIG. 2 is a schematic view of an electrostatic cyclone filter for use in the vacuum cleaner of FIG. 1.

FIG. 2 shows an optional cyclonic electrostatic dust filter stage 50 for use in combination with electrostatic dust filter 30. Cyclonic filter stage 50 comprises a cylindrical chamber 52 including an entry port 54 at an upper end thereof and a hollow central cylindrical exit tube 56 defining a plurality of exit holes 58 at a lower end thereof.

Dust laden air is drawn in via entry port 54 from where it is directed towards the lower exit holes 58 following a circular motion principally against an electrically conductive chamber inner wall 52A of chamber 52 which is electrically connected to one terminal of a DC supply. The dust particles are attracted to the electrically conductive inner wall 52A and this together with the centrifugal force causes the dust to separate from the airflow and be retained on chamber inner wall 52A. Meanwhile the air exits chamber 52 via outlet 59 at an upper end of central exit tube 56.

Since it is advantageous for chamber inner wall 52A to have a large surface area so as to better attract more dust particles, the surface can be corrugated in the vertical direction providing a localized degree of turbulence and extra surface to retain dust.

The polarity of inner wall surface can be positive or negative to suit the circumstance of the particular type of dust and conditions that prevail in the local atmosphere.

Central exit tube 56 is electrically connected to the opposite DC supply connection to that of chamber inner wall 52A. Thus there is an electric field across the space between central exit tube 56 and chamber inner wall 52A. This field acts on the dust particles to attract them to chamber inner wall 52A.

When chamber 52 is substantially full with dust particles it can be emptied by allowing chamber inner wall 52A to be connected to a ground or earth connection rather than the DC supply terminal. This allows for charge built up in and on the dust particles to be partially discharged and the dust to be free of its attraction to chamber inner wall 52A.

Chamber 52 may be followed by a second chamber (not shown) of similar function wherein any remnant particles of dust are captured, before the transport air is directed towards an exit to atmosphere point.

On its way to the exit to atmosphere, the vacuum cleaner 10 may optionally balance the net charge carried by the airstream so that an overall negative charge state exists on exit from the vacuum cleaner.

In one embodiment, conductive chamber inner wall 52A comprises a conductive substrate coated with a thin coating of insulating material, preferably though not exclusively a ceramic material, chosen to have maximum triboelectric properties and as such readily gives up or accepts electrons as a consequence of friction with the dust particles passing over its surface. The coating is very thin (e.g. no greater than 5 nm in thickness) to allow quantum tunneling to take place and allow charge to migrate to the conductive substrate and thus provides a current flow into a suitable storage device such as a capacitor or alternatively directly into a load circuit of some kind.

By way of example, if cyclonic filter stage 50 operates with a negative voltage at the substrate (with respect to exit tube 56), dust particles will be in frictional contact with chamber inner wall 52A which has a positive triboelectric characteristic—i.e. readily gives up electrons. As the dust particles extract electrons from the surface of the coating on the chamber inner wall 52A they become negatively charged and the surface material gains a positive charge. As this positive charge accumulates, quantum tunneling migrates electrons from the conductive substrate to the surface of the coating to neutralise the charge and allow the cycle to progress. Thus an electron flow is established. The dust meanwhile is first attracted to surface of the coating and subsequently, after the electron neutralization, is allowed to fall and accumulate at the bottom of chamber 52. In this example the air is also negatively charged and so has an improved quality state prior to it's exit at an exhaust point.

As will be apparent to the skilled reader, the polarity in the cyclonic filter stage 50 can be reversed so that the air leaving chamber 52 has a positive charge state. In this case, the outgoing air may be passed through a conditioner stage that removes the positive charge and gives the air with a negative charge—thus again improving the overall air quality. It can also be arranged to further trap/remove any remnant dust particles. However, in this latter case the balance of the positive charge first acquired by the air and the subsequent negative charge result in a closed circuit of charge flow between the two sections. This charge flow is thus an energy extraction system taking electrical energy from the kinetic air flow. The energy can either be accumulated to be used to power the process itself, or be extracted for other purposes (e.g. powering another part of the vacuum cleaner).

Further embodiments of electrostatic cyclonic filter stage 50 include a series of vertically orientated electrodes instead of a continuous conductive substrate, each electrode connected to a different phase of control. By sequencing the energisation of the electrodes, a rotating electric field can be established. The rotating field can be used to both drive the flow of air and dust particles and also to sequence the collection of triboelectric generated electron flow.

Either arrangement can be organized to be conical in form so that velocities of the rotating flows can be optimized.

Figure 3:
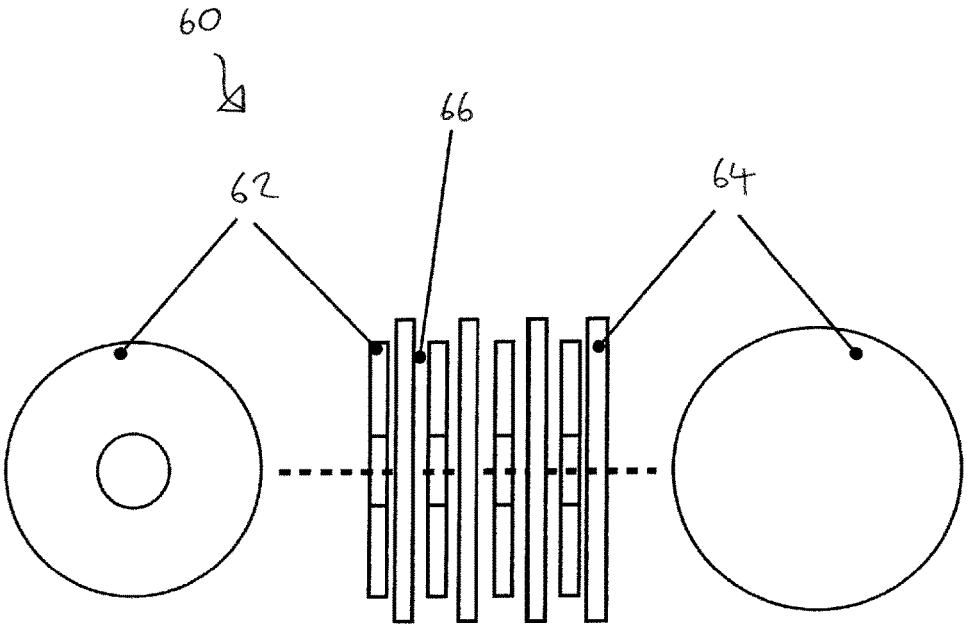
FIG. 3 is a schematic view of an air pump for use in the vacuum cleaner of FIG. 1.

FIG. 3 shows a Tesla turbine impeller device 60 for use as air pump 40 in vacuum cleaner 10.

Tesla turbine 60 comprising an arrangement of rotor discs 62 are mounted on a common axis spaced between interposed stator discs 64 with a running clearance 66.

As in a conventional Tesla Turbine, air is drawn in at the axis, accelerated and expelled at the periphery where a containing chamber catches and directs the output. This process provides for very quiet operation as there are no impeller blades.

By making rotor and stator discs 62, 64 alternately positive and negative in charge, the resultant electrostatic charge further enhances the drag and hence the pumping effectiveness, whilst at the same time providing for either or both, air quality improvement and or dust particle ionization. The dust ionization/charging can then subsequently be used to filter out the dust by collection on suitably charged plates following the turbine stage.

Additionally rotor and stator discs 62, 64 may be coated with a thin (e.g. less than 5 nm in thickness) triboelectric coating to induce friction generated electron flow and collection via quantum tunneling effect to a substrate conductor or conductors.

By suitably arranging electrodes radially on the stator discs of a Tesla turbine device (e.g. based on the principles of known electrostatic motors), it is possible to provide an electrostatic force that spins rotor discs 62 relative to stator discs 64. In this way the motor can also perform as the air pump (e.g. impeller) as the air movement is required to be the same as a simple Tesla turbine impeller. That is the motor rotors and stators are the turbine rotors and stators 62, 64.

The invention claimed is:

1. A vacuum cleaner comprising:

a body defining an air inlet, an air outlet, and a passageway extending therebetween;

a dust filter for removing dust from air as it passes through the passageway; and an air pump for drawing air into the air inlet and through the passageway to the air outlet;

wherein the vacuum cleaner further comprises an electrode arrangement operative to provide a motive force to drive an electrostatic motor mechanically coupled to the air pump or to provide a motive force to directly drive the air pump;

wherein the air pump comprises a Tesla turbine comprising at least one stator disc in combination with at least one rotor disc and the electrode arrangement is provided on the at least one stator disc to cause rotation of the corresponding rotor disc.

2. A vacuum cleaner according to claim 1, wherein the passageway or a component located in the passageway includes an airflow contact surface comprising a triboelectric coating provided on an electrically conductive underlayer configured to supply a voltage to the electrode arrangement.

3. A vacuum cleaner according to claim 1, wherein the air pump comprises an active element including an airflow contact surface comprising a triboelectric coating provided on an electrically conductive layer configured to supply a voltage to the electrode arrangement.

4. A vacuum cleaner according to claim 1, wherein the electrostatic dust filter includes a cyclonic filter stage including a cyclonic airflow contact surface comprising a triboelectric coating provided on an electrically conductive underlayer configured to supply a voltage to the electrode arrangement.

5. A vacuum cleaner according to claim 1, wherein the vacuum cleaner is configured to generate an ionised airflow through the air outlet.

* * * * *